United States Patent [19]

Ruger et al.

[11] 3,942,279

[45] Mar. 9, 1976

[54] REMOVABLE FILLER STRIPS FOR DOUBLE BARREL FIREARMS

[75] Inventors: William B. Ruger, Southport; Lawrence L. Larson, Bethany, both of Conn.

[73] Assignee: Sturm, Ruger & Co. Inc., Southport, Conn.

[22] Filed: Oct. 29, 1974

[21] Appl. No.: 518,807

[52] U.S. Cl. ..... 42/76 R

[51] Int. Cl.[2] ..... F41C 21/06; F41C 21/08

[58] Field of Search ..... 42/76 R, 75 A, 75 B

[56] References Cited

UNITED STATES PATENTS

| | | | |
|---|---|---|---|
| 1,467,502 | 9/1923 | Rose | 42/76 R |
| 1,468,902 | 9/1923 | Fabry et al. | 42/76 R |
| 1,785,765 | 12/1930 | Burton | 42/76 R |
| 3,365,831 | 1/1968 | Wallace | 42/76 R |
| 3,651,594 | 3/1972 | Hillberg | 42/76 R |

*Primary Examiner*—Charles T. Jordan

*Attorney, Agent, or Firm*—Pennie & Edmonds

[57] ABSTRACT

A double barrel firearm having two parallel barrels spaced apart by a front spacer secured to the barrels at the forward ends thereof and by a rear spacer secured to the barrels toward the rearward ends thereof is provided with a removable filler strip assembly for filling the space between the barrels. The removable filler strip assembly comprises a pair of filler strips which extend along opposite sides of the barrels in the space between the barrels from the forward end of the rear spacer to the rearward end of the front spacer. Filler strip engaging means at the forward ends of the filler strips releasably connect said forward ends to the front spacer, and filler strip retainer means releasably secured to the rear spacer releasably connect the rearward ends of the filler strips to the rear spacer.

8 Claims, 9 Drawing Figures

REMOVABLE FILLER STRIPS FOR DOUBLE BARREL FIREARMS

BACKGROUND OF THE INVENTION

1. Field of the Invention

This invention relates to double barrel firearms, and in particular to filler strips for filling the space between the barrels.

2. Prior Art

Double barrel firearms to which the present invention relates include both shotguns and rifles having two substantially parallel barrels disposed either vertically (over-and-under) or horizontally (side-by-side) with respect to each other. The two parallel barrels of this type of firearm are spaced a predetermined distance apart and are carefully positioned in order to make sure that the bores of the barrels are aligned with respect to each other exactly as intended by the gunmaker. (That is to say, the axes of the bores may be exactly parallel or they may converge slightly so as to meet at a common point a predetermined distance from the muzzle of the barrels). The two barrels are permanently fixed in this position by a front spacer secured to the facing surfaces of the barrels at the forward ends thereof and by a rear spacer secured to the facing surfaces of the barrels toward the rearward ends thereof. The front and rear spacers are secured to the barrels advantageously by silver soldering or brazing these parts together, although they may also be secured together by soft solder or some other means. When thus secured together the two barrels are separated by a roughly hourglass-shaped space that extends from the forward end of the rear spacer to the rearward end of the front spacer. That is to say, the spaced parallel barrels define a longitudinally extending space having generally triangular cross sections on opposite sides of the barrels.

Although in some double barrel firearms the space between the barrels is allowed to remain open, it is more usually the practice to fill in or enclose the space between the barrels by means of a pair of filler strips which extend along opposite sides of the barrels from the rear spacer to the front spacer. The filler strips are usually secured to the barrels by a soft lead-base solder or, less commonly, by a hard silver solder. In all cases, when soldering the filler strips to the barrels it is very important that a moisture tight joint be obtained between the filler strips and the barrels in order to prevent moisture from entering the space between the barrels enclosed by the filler strips where it eventually will cause rust to form in an area inaccessible for cleaning.

After extended use in the field, it may be necessary to resolder the filler strips to the barrels, or the barrel assembly may need rebluing. However, soft solder will not withstand modern bluing solutions and if subjected to these solutions it will disintegrate, thereby causing the filler strips to separate from the barrels. If the barrel filler strips are silver soldered to the barrels the resulting assembly can be blued and reblued with modern bluing solutions. However, the use of silver solder requires excessive local heating of the barrels which causes warping and distortion of the parallel alignment of the barrels. As it is extremely difficult to straighten and align the barrels after the barrels are soldered together, the use of silver solder is not widely practiced. Moreover, modern bluing solutions and bluing salts are extremely corrosive to steel. It is imperative therefore that the joint between the filler strips and the barrels be moisture tight in order to prevent entrapment of bluing salts from the bluing solution in the space enclosed by the filler strips.

After an intensive investigation of the aforementioned problems associated with the securing of filler strips to the barrels of double barrel firearms, we have now devised a novel barrel and filler strip assembly by means of which the filler strips are removably secured to the barrels of the firearm. The removable filler strips of the invention fit neatly into the generally triangular spaces on opposite sides of the barrels when secured to the barrels, and they can readily be removed from the barrels to expose the space between the barrels for routine cleaning, or for rebluing if necessary.

SUMMARY OF THE INVENTION

The removable filler strips of the invention are employed in conjunction with double barrel firearms having two generally parallel barrels spaced a predetermined distance apart by a front spacer secured to the facing surfaces of the two barrels at the forward ends thereof and by a rear spacer secured to the facing surfaces of the barrels toward the rearward ends thereof. The removable filler strip assembly comprises a pair of filler strips which extend along opposite sides of the barrels in the roughly hour-glass shaped space that extends between the barrels from the forward end of the rear spacer to the rearward end of the front spacer. Filler strip engagement means are disposed at the forward end of the filler strips for releasably connecting the forward ends thereof to the front spacer, and filler strip retainer means are removably secured to the rear spacer for releasably connecting the rearward ends of the filler strips to the rear spacer.

In an advantageous embodiment of the invention each of the filler strips is formed with a forwardly extending inner lip portion at the forward end thereof and with a rearwardly extending outer lip portion at the rearward end thereof. The front spacer is formed with a recess at the rearward end thereof in which recess the forwardly extending inner lip portions of the filler strips are removably received. The rear spacer is formed with a pair of cutout portions at the forward end thereof in which cutout portions of the rearwardly extending outer lip portions of the filler strips are removably received. The retainer means removably secured to the rear spacer releasably retain the rearwardly extending outer lip portions of the filler strips in the cutout portions of the rear spacer.

BRIEF DESCRIPTION OF THE DRAWINGS

The novel filler strip assembly of the invention will be better understood from the following description thereof in conjunction with the accompanying drawings of which.

FIGS. *5a* and *5b* are fragmentary sectional views corresponding to the forward end of FIG. 4 and to the rearward end of FIG. 4, respectively.

DESCRIPTION OF PREFERRED EMBODIMENT

Figures 1, 2, 3, 4, 5A, 5B:
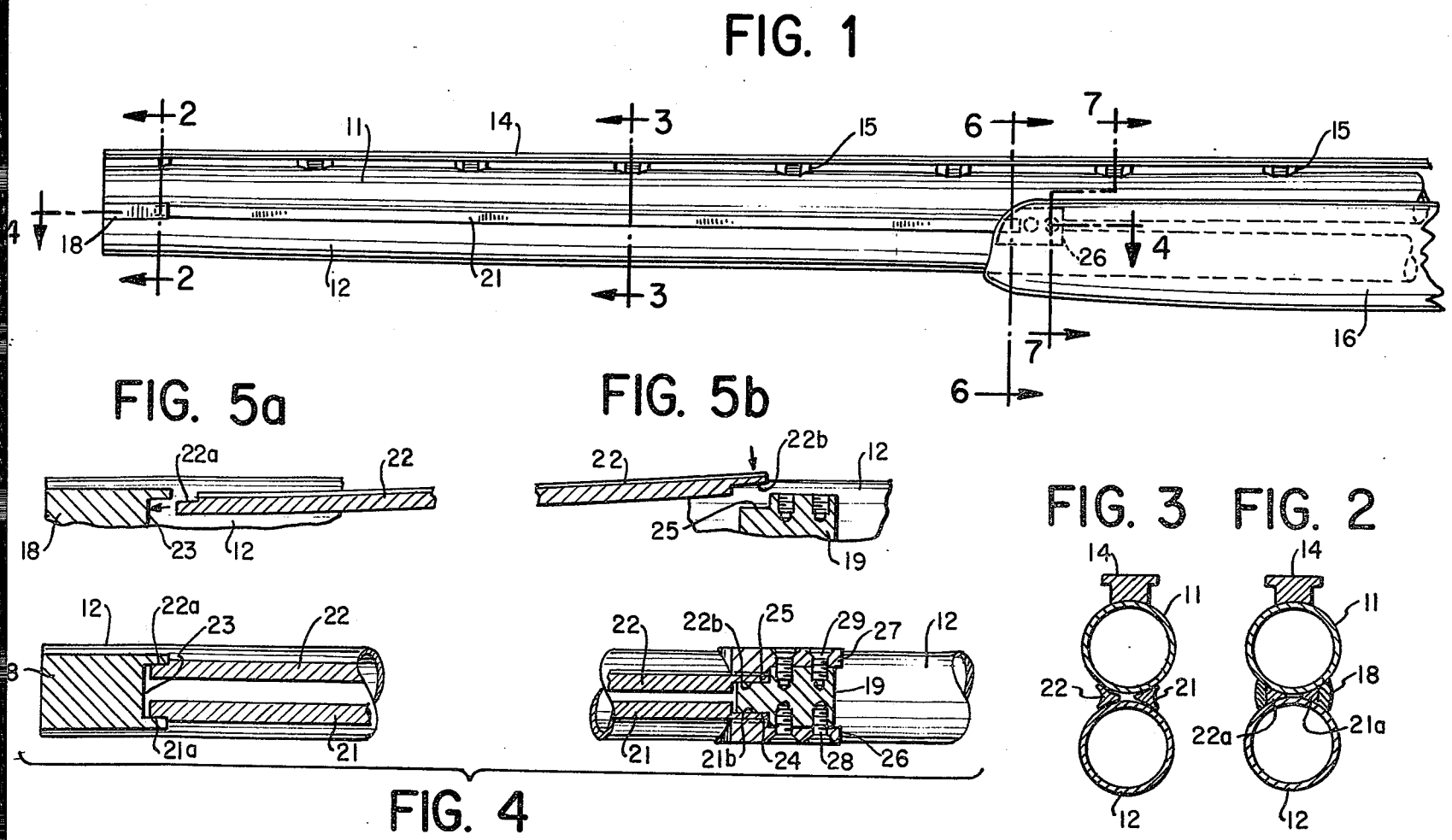
FIG. 1 is a partial side elevation of a double barrel over-and-under firearm embodying the removable filler strip assembly of the invention.
FIG. 2 is a sectional view along line 2—2 of FIG. 1.
FIG. 3 is a sectional view along line 3—3 of FIG. 1.
FIG. 4 is a sectional view along line 4—4 of FIG. 1.
Figure 8:
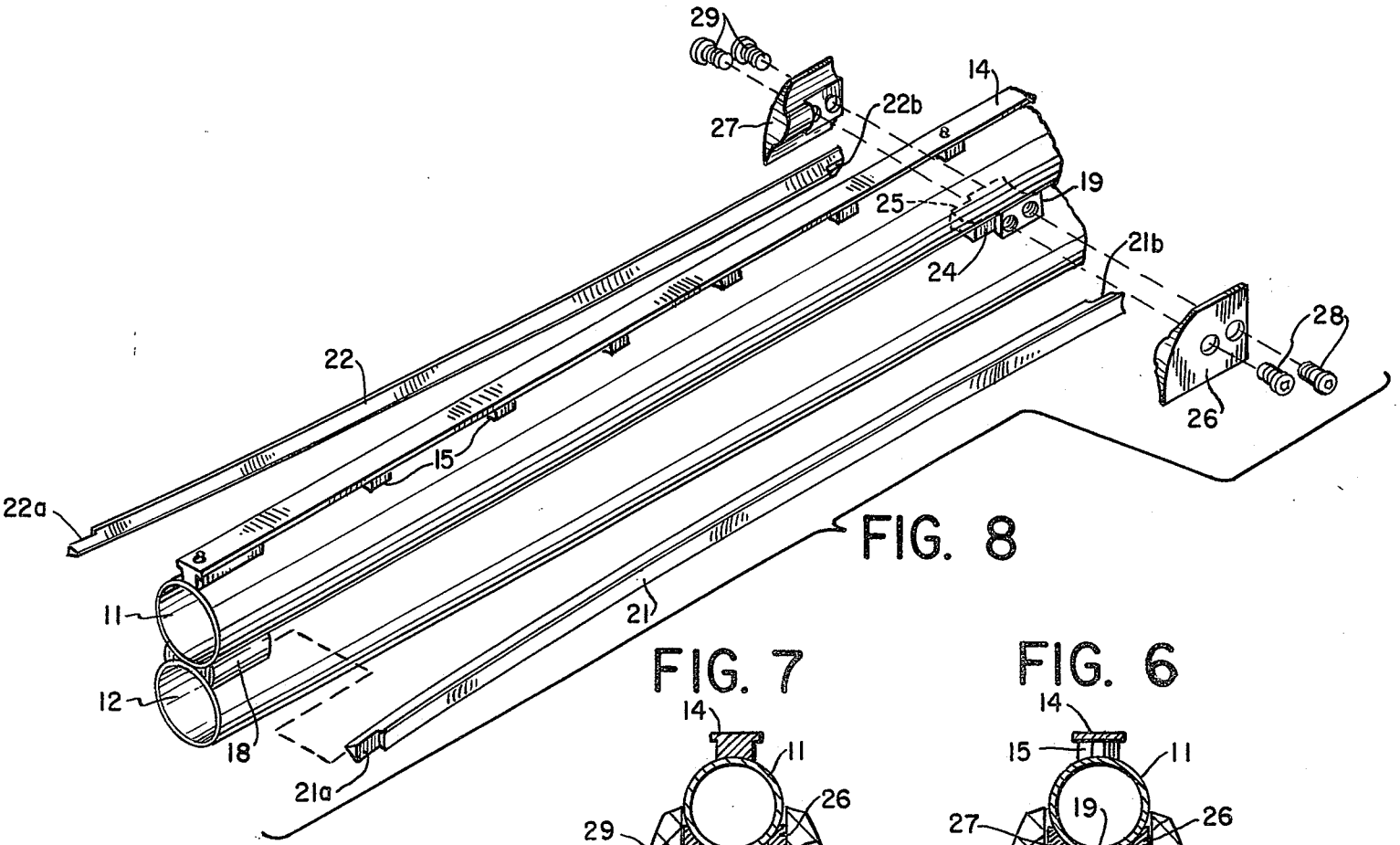
FIG. 8 is an exploded perspective view of the double barrel firearm and filler strip assembly of FIG. 1.
Figure 6:
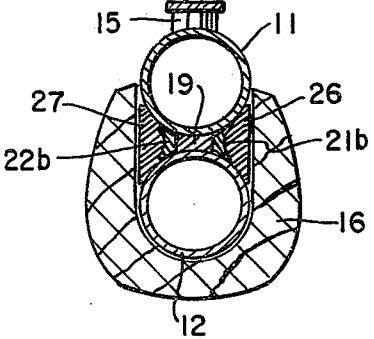
FIG. 6 is a sectional view along line 6—6 of FIG. 1.
Figure 7:
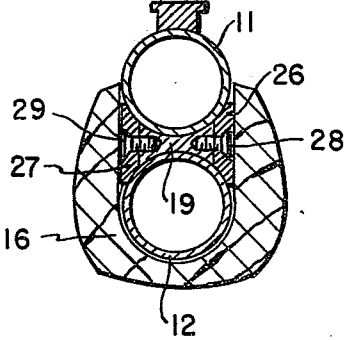
FIG. 7 is a sectional view along line 7—7 of FIG. 1

As previously noted, the filler strip assembly of the invention is applicable to double barrel firearms, including both shotguns and rifles, having two substantially parallel barrels disposed either vertically (over-and-under) or horizontally (side-by-side) with respect to each other. In the embodiment shown in the drawings the filler strips are applied to and are a part of the barrel and filler strip assembly of a double barrel over-and-under shotgun.

The two barrels 11 and 12 of the over-and-under shotgun are secured at their rearward ends to a receiver and gunstock of essentially conventional design that are not shown in the drawings. As shown best in FIG. 1, a longitudinal aiming rib 14 is secured to the upper surface of the barrel 11 by spacers 15, and the rearward ends of the barrels 11 and 12 are partially enclosed in the forearm 16 of the gunstock. As shown best in FIGS. 2, 3, 6 and 7, the barrels 11 and 12 are spaced a predetermined distance apart and are carefully positioned in order to make sure that the bores of the barrel are aligned exactly as intended by the gunmaker. That is to say, the axes of the bores may be exactly parallel or, as shown in the drawings, they may converge slightly so as to meet at a common point a predetermined distance from the muzzles of the barrels. As shown best in FIGS. 2, 6, 7 and 8, the two barrels are permanently fixed in this position by a front spacer 18 secured to the facing surfaces of the barrels 11 and 12 at the forward ends thereof and by a rear spacer 19 secured to the facing surfaces of the barrels toward the rearward ends thereof. The front and rear spacers 18 and 19 and the barrels 11 and 12 are advantageously secured by silver soldering or brazing these parts together, although they may be secured together by soft solder or other means. When thus secured together the two barrels are separated by a roughly hourglass-shaped space (shown best in FIG. 3) that extends from the forward end of the rear spacer 19 to the rearward end of the front spacer 18. That is to say, the spaced parallel barrels define a longitudinally extending space having generally triangular cross sections on opposite sides of the barrels.

The filler strip assembly comprises a pair of filler strips 21 and 22 adapted to partially fill the hourglass-shaped space between the barrels, the filler strips extending along the sides of the barrels 11 and 12 from the forward end of the rear spacer 19 to the rearward end of the front spacer 18. As noted, the longitudinally extending space between the barrels 11 and 12 has generally triangular cross sections on opposite sides of the barrels, and as best shown in FIG. 3 the filler strips 21 and 22 advantageously also have generally triangular cross sections so as to fit neatly into the longitudinal space on opposite sides of the barrels. Filler strip engagement means are disposed at the forward ends of the filler strips 21 and 22 for releasably connecting the forward ends thereof to the front spacer 18, and filler strip retainer means are removably secured to the rear spacer 19 for releasably connecting the rearward ends of the filler strips to the rear spacer.

In the embodiment shown in the drawings, each of the filler strips 21 and 22 is formed with a forwardly extending inner lip portion 21*a* and 22*a* at the forward end thereof and with a rearwardly extending outer lip portion 21*b* and 22*b* at the rearward end thereof. The front spacer 18 is formed with a recess 23 at the rearward end thereof in which recess the forwardly extending inner lip portions 21*a* and 22*a* of the filler strips 21 and 22 are removably received. The rear spacer 19 is formed with a pair of cutout portions 24 and 25 at the forward end thereof in which cutout portions the rearwardly extending outer lip portions 21*b* and 22*b* of the filler strips 21 and 22 are removably received. Filler strip retainer means are removably secured to the rear spacer 19 and are adapted to releasably retain the rearwardly extending outer lip portions 21*b* and 22*b* of the filler strips 21 and 22 in the cutout portions 24 and 25 of the rear spacer 19. The filler strip retainer means advantageously comprises a pair of filler blocks 26 and 27 which overlie the rearwardly extending outer lip portions 21*b* and 22*b* of the filler strips and which are removably secured to the rear spacer 19 by the screws 28 and 29.

The filler strips 21 and 22 may be made of extruded plastic or of a metal such as aluminum or brass. However, in the preferred embodiment the filler strips 21 and 22 are formed of steel so that these parts may be given the same surface finish (for example, bluing) as the barrels. The steel filler strips may be rolled or machined to obtain the desired generally triangular cross section. However, these parts are advantageously formed by drawing through appropriately shaped dies to obtain a continuous metal strip having the desired cross section which can then be cut into shorter lengths for use in the filler strip assembly of the invention. Each filler strip 21 and 22 is advantageously bowed slightly inwardly between its forward and rearward ends so that, when the forwardly extending inner lip portions 21*a* and 21*b* are inserted in the recess 23 of the front spacer 18, the rearward ends of the filler strips must be pressed inwardly against the spring resistance of the bowed filler strips as shown in FIG. 5*b* in order to have the rearwardly extending outer lip portions 21*b* and 22*b* enter and be received in the cutout portions 24 and 25 of the rear spacer 19. The slightly bowed configuration of the filler strips insures that the filler strips are pressed firmly into the generally triangular shaped spaces on opposite sides of the barrels so as to prevent movement or vibration of these parts when the firearm is discharged.

In the manufacture and assembly of the firearm, the two barrels 11 and 12 are carefully aligned and secured together by means of the spacers 18 and 19 as previously described. The barrel assembly, filler strips 21 and 22 and filler blocks 26 and 27 are then given the desired surface finish (for example, bluing) and are assembled together as follows: The forwardly extending inner lip portion 21*a* and 22*a* of the filler strips 21 and 22 are inserted in the recess 23 of the front spacer 18 as shown best in FIGS. 2, 4 and 5*a*. The rearwardly extending outer lip portions 21*b* and 22*b* of the filler strips 21 and 22 are then pressed into the cutout portions 24 and 25 of the rear spacer 19 as shown best in FIG. 5*b*. The filler blocks 26 and 27 are then secured to the rear spacer 14 with the screws 28 and 29 to retain the lip portions 21*b* and 22*b* in the cutout portions 24 and 25, respectively, as shown best in FIGS. 4, 6, and 7. The barrel and filler strip assembly is then secured to the forearm 16 and stock of the firearm in the usual manner. The firearm can readily be dissassembled and the filler strips 21 and 22 removed without the use of special tools in order to permit routine cleaning and oiling of the barrels, and in particular the normally inaccessible space between the barrels, whenever desired.

We claim:

1. In a double barrel firearm having two generally parallel barrels spaced a pre-determined distance apart by a front spacer secured to the facing surfaces of said barrels at the forward ends thereof and by a rear spacer secured to the facing surfaces of said barrels toward the rearward ends thereof, the improvement which comprises a removable filler strip assembly for filling the space between the barrels from the rear spacer to the front spacer, said removable filler strip assembly comprising:

a pair of filler strips which extend along opposite sides of said barrels in the space between said barrels from the forward end of the rear spacer to the rearward end of the front spacer, filler strip engaging means at the forward ends of said filler strips for releasably connecting said forward ends to the front spacer, and filler strip retainer means removably secured to the rear spacer for releasably connecting the rearward ends of said filler strips to said rear spacer.

2. The firearm according to claim 1 in which the spaced parallel barrels define a longitudinally extending space having generally triangular cross sections on opposite sides of the barrels, and in which the filler strips are removably received in said generally triangular spaces on said opposite sides of said barrels.

3. The firearm according to claim 2 in which the filler strips have a generally triangular cross section.

4. The firearm according to claim 1 in which the filler strips are bowed longitudinally inwardly between the rearward and forward ends thereof.

5. The firearm according to claim 1 in which the forward ends of the filler strips are each formed with a forwardly extending inner lip portion, and in which the front spacer is formed with a recess portion at the rearward end thereof in which recess portion the forwardly extending inner lip portions of the filler strips are removably received.

6. The firearm according to claim 1 in which the rearward ends of the filler strips are each formed with a rearwardly extending outer lip portion, in which the rear spacer is formed with a pair of cutout portions at the forward end thereof in which cutout portions the rearwardly extending outer lip portions of the filler strips are removably received, and in which the retainer means removably retain the rearwardly extending outer lip portions of the filler strips in the cutout portions of the rear spacer.

7. The firearm according to claim 6 in which the retainer means comprise a pair of filler blocks adapted to overlie the rearwardly extending outer lip portions of the pair of filler strips and the adjoining portions of the rear spacer, said filler blocks being removably secured to said rear spacers.

8. The firearm according to claim 1 in which each of the filler strips is formed with a forwardly extending inner lip portion at the forward end thereof and with a rearwardly extending outer lip at the rearward end thereof, in which the front spacer is formed with a recess portion at the rearward end thereof in which recess portion the forwardly extending inner lip portions of the filler strips are removably received, in which the rear spacer is formed with a pair of cutout portions at the forward end thereof in which cutout portions the rearwardly extending outer lip portions of the filler strips are removably received, and in which the retainer means removably secured to the rear spacer retain the rearwardly extending outer lip portions of the filler strips in the cutout portions of the rear spacer.

* * * * *